US005587567A

United States Patent [19]

Winter et al.

[11] Patent Number: 5,587,567

[45] Date of Patent: Dec. 24, 1996

[54] PUSH BUTTON PANEL FOR AN ELEVATOR

[75] Inventors: Ari Winter, Hyvinkää; Johannes de Jong, Järvenpää, both of Finland

[73] Assignee: Kone Oy, Helsinki, Finland

[21] Appl. No.: 273,901

[22] Filed: Jul. 12, 1994

[30] Foreign Application Priority Data

Jul. 26, 1993 [FI] Finland ..... 933340

[51] Int. Cl.[6] ..... B66B 1/34; H01H 1/00

[52] U.S. Cl. ..... 187/395; 200/600; 200/502

[58] Field of Search ..... 187/395, 380, 187/413, 901; 200/512, 502, 600

[56] References Cited

U.S. PATENT DOCUMENTS

| | | | |
|---|---|---|---|
| 4,805,739 | 2/1989 | Lind et al. | 187/121 |
| 4,857,887 | 8/1989 | Iten | 341/34 |
| 4,975,676 | 12/1990 | Greenhalgh | 338/114 |
| 5,040,640 | 8/1991 | Slabinski et al. | 187/121 |
| 5,149,986 | 9/1992 | Jalbert | 307/117 |
| 5,243,162 | 9/1993 | Kobayashi | 200/512 |
| 5,477,942 | 12/1995 | Shea et al. | 187/395 |

FOREIGN PATENT DOCUMENTS

| | | | |
|---|---|---|---|
| 4-101973 | 4/1992 | Japan | 187/395 |
| 4-209177 | 7/1992 | Japan | 187/395 |
| 1573394 | 8/1980 | United Kingdom . | |
| 2241090 | 8/1991 | United Kingdom | 187/395 |

*Primary Examiner*—Robert Nappi

*Attorney, Agent, or Firm*—Birch, Stewart, Kolasch & Birch, LLP

[57] ABSTRACT

The invention relates to a push button panel for an elevator. The push button panel includes a front panel and push button areas provided on the front surface of the front panel. The front panel is made of a material having a high degree of rigidity. At least in the regions of the push button areas, the back surface of the front panel is provided with elements sensitive to pressure changes. The sensor element is connected by at least one signal conductor to the data transmission system of the elevator. The sensor element preferably consists of a film which, when subjected to mechanical work, produces an electric signal.

13 Claims, 1 Drawing Sheet

PUSH BUTTON PANEL FOR AN ELEVATOR

BACKGROUND OF THE INVENTION

The present invention relates to a push button panel for an elevator.

The calls used to operate an elevator are usually given by pressing push buttons placed at the landings and in the elevator cars. The signal issued by a push button is transmitted directly, or after processing, to the elevator control system, which generally returns feedback information concerning receipt of the call in the form of an indication via the push button itself or a signaling device placed near it. This call acknowledgement signal given as feedback information is often issued by means of a signal light. In practical solutions, the push buttons for an elevator can be implemented in various ways and, in normal conditions and if properly used, the solutions employed generally work without problems.

In certain elevators and certain situations, incorrect or even violent treatment of the push buttons becomes a problem. Deliberate vandalism directed at push buttons or associated equipment, besides damaging the equipment in question, may cause disturbances in the whole elevator system. Such a disturbance is produced e.g. by a damaged landing call device stuck in a position where it sends a continuous call signal. Push buttons are also jammed with chewing gum, sticks, tape etc. so that they remain continuously on. The structures and materials of conventional push buttons are seldom designed to withstand abnormal service conditions.

There are several known solutions in this field which aim at solving the problem referred to above and producing push buttons capable of withstanding rough treatment and exceptionally difficult service conditions. However, the existing solutions are expensive and complicated.

SUMMARY OF THE INVENTION

The object of the invention presented in this patent application is to achieve a new push button panel which is applicable for use with an elevator and as insensitive to external disturbing factors as possible and which still guarantees a reliable transmission of call signals to the elevator control system.

The push button panel of the invention is completely insensitive to external disturbing factors in situations which can be expected in practice. Even using an arm blanche, a hammer or other striking tool to give a call will not cause any disturbance in the transmission of calls or in subsequent operation of the push button. The push buttons have no parts protruding from the panel which could be damaged, but all functions take place behind a plate or wall and are thus protected. Customer-specific requirements regarding the appearance of the push button panel can be easily taken into account because no specially designed components are needed which would be expensive to produce, but the customers' wishes can be fulfilled by using patterns formed on the panel. As the push button panel is of a flat construction, it does not require a deep cavity for mounting.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
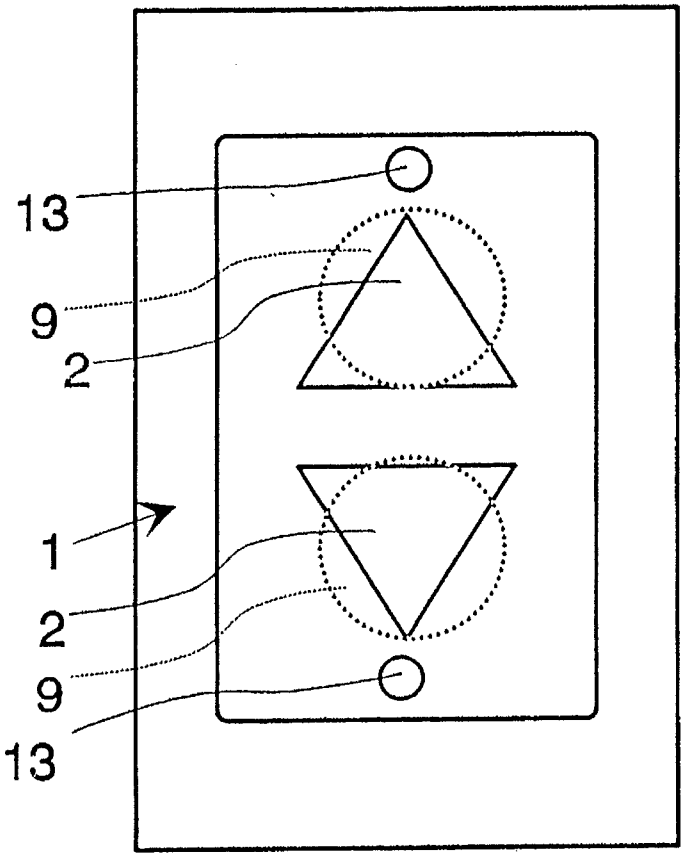
FIG. 1 presents a push button panel according to the invention, placed at a landing and seen in front view.

FIG. 1 presents the push buttons in a landing call device, i.e. a push button panel placed at a landing. Such devices, like the one presented in this application, are usually provided with push buttons for both up calls and down calls. In the push button panel, the call button patterns 2 forming the button areas are made on the surface of the front plate of the push button panel, which is essentially even and continuous over the whole panel area, by painting, glueing a thin surface layer onto it, etching, engraving, anodizing or by some other method which is suitable with regard to manufacture and produces a sufficiently durable pattern.

Figure 2:
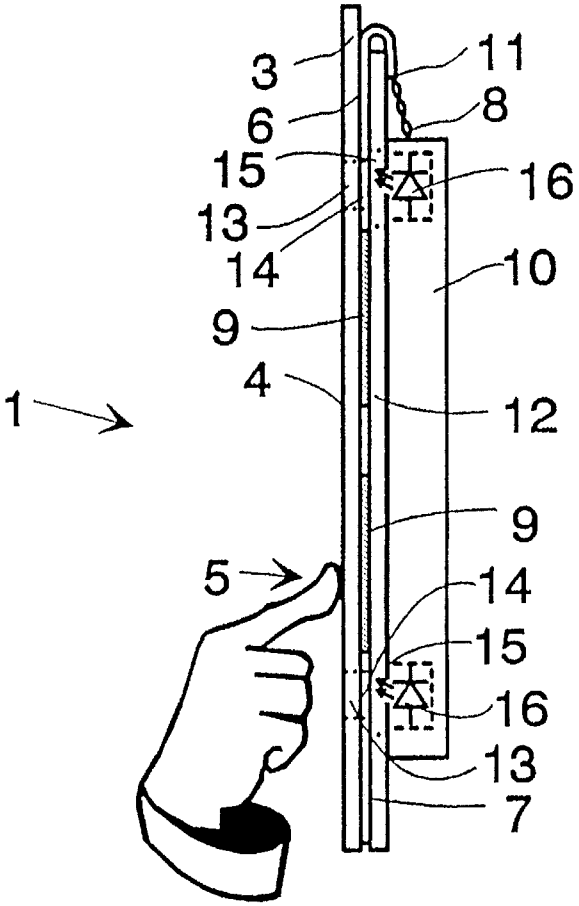
FIG. 2 illustrates the structure of the panel in side view.

FIG. 2 shows the push button panel 1 in side view. The external or front surface 4 of the front plate 3 of the push button panel, which is visible to the user, is provided with push button patterns 2 as illustrated by FIG. 1. The front plate 3 is made of a fairly rigid material, e.g. sheet metal of a thickness of one or two millimeters. However, the front plate must not have an absolute rigidity but it has to yield somewhat to pressure. After yielding, the plate is restored to its previous shape, and this takes place either by bending or in the form of a slight local deformation or as a combination of these. For the operation of the push buttons, it makes no difference if the front plate 3 is implemented as a part integrated with the plate structure of the car wall or landing wall or as a separate plate. The car wall or landing wall plate structure usually consists of a landing door jamb sheet or a car wall panel. A deflection sufficient to produce a call signal is produced e.g. by pressing 5 with a finger. Regardless of whether the front plate 3 is mounted in place e.g. by attaching it to the wall structure by using fixing elements such as screws or glue placed at a distance of e.g. 5–10 cm from the push button pattern 2 or whether the front plate forms part of a larger plate such as a landing door jamb sheet or a car wall panel, a large local displacement or pressure due to the deflection of the plate 3 occurs at the point where the pressure 5 is applied. Attached to the back surface 6 of the front plate 3 is a film 7 whose deformation produces an electric signal in a signal conductor 8. Typically the film 7 is very thin, only a fraction of a millimeter. In the film 7, a signal is preferably only generated in the film areas 9 under the button regions 2 marked on the front plate 3. The film parts 9 under the push button areas which are active in the signal generation process are not necessarily of the same size and shape with the push button areas 2.

The signal conductor 8 passes the signal to an electronics unit 10 in the push button panel. On the basis of the push button signal, this unit produces the actual call to be sent to the elevator control system via the data transmission system. As seen from the point of view of the data transmission system of the elevator, the electronics unit is in the simplest case an amplifier which amplifies the push button signal, but in an elevator system employing serial data transmission, one of the functions of the electronics unit is to generate and transmit the messages corresponding to the calls into the serial communication bus in accordance with the bus protocol. In practice, the push button signal may consist of a frequency change which, following a deformation of the film 7, due to a change in capacitance between electrodes attached to the push button areas 2 of the film, occurs in an oscillating circuit in which the capacitance between the electrodes forms a part via the signal conductors 8, or the signal may be a pulse of electric energy generated in the film when the latter is of a type converting mechanical energy into electrical energy. In such a structure, the electrodes affect the properties of the film portion 9 under them so that it will generate a signal. For instance, an elastic, electrically insulating film made of a plastic material and provided on either side with an electrode made by a metal deposition method or from conductive plastic and with gas bubbles inside it which are compressed by the pressure applied to the film can be regarded as functioning in any one of the two ways mentioned above. At least part of the signal conductors is preferably formed in the film in the same way as the electrodes, so that the push button signal is available at the edge 11 of the film. The signal conductors formed in the film have a small area, so when the button is pressed, they cannot produce a sufficient signal like the film portions 9 under the electrodes. Behind the film there is a back plate 12. When the film is compressed between the front plate 3 and back plate 12, it is subjected to a stronger pressure effect and therefore the signal generated by the pressure is also larger.

The front plate is provided with a small window opening 13. The film 7 and the back plate are provided with a hole 14, 15 placed in the area directly under the window opening, or they are at least translucent, permitting the light of an LED 16 placed behind the push button panel 1 and controlled by the electronics unit 10 of the push button panel to illuminate the window 13. The light of the LED 16 is used to indicate receipt of the call. The window opening is filled with a transparent, possibly colored plastic or other window material, or the window opening is formed by making a number of smaller holes, which can be filled with a window material. Thus, it will not be possible to insert any object, such as a match or a key, into the window opening 13.

It is obvious to a person skilled in the art that the front plate may also be transparent or translucent in the manner of smoked glass, for example, a plate made of hard translucent plastic, in which case it will be easy to combine the push button with a signal light by mounting a LED unit or some other type of illuminating component in the push button area on the backside of the plate. It is further obvious to a skilled person that the film may be provided with an electrode on one side only, the other electrode consisting of the conducting mounting base of the film, or the film may be composed of two films provided with an electrode pattern on one side and layered so as to form a single structure as regards the capacitance. By using multilayer film structures and suitably combining the signals obtained from different layers in an electric circuit, it is possible to achieve a push button which, when pressed, produces an electric signal of multiple strength. It is also obvious that the electronics unit need not necessarily be placed directly behind the push button panel.

The invention has been described above by the aid of some of its embodiments. However, the presentation is not to be regarded as limiting the sphere of patent protection, but instead the embodiments of the invention may vary within the limits defined by the following claims.

We claim:

1. A push button panel comprising:

a substantially rigid front plate having a front surface and a rear surface, said front surface including at least one push button area located thereon;

a back plate located proximate to said rear surface of said front plate, said back plate including a first aperture;

a pressure sensitive film located between said front plate and said back plate and abutting said front plate and said back plate, said pressure sensitive film including a second aperture;

at least one signal conductor associated with said pressure sensitive film for conducting a signal produced by said pressure sensitive film; and indicator means aligned with said first aperture and said second aperture for indicating when mechanical work has been applied to the push button area, said indicator means being visible through said first aperture, said second aperture, and a portion of said front plate;

whereby mechanical work applied to the push button area is transferred to the pressure sensitive film to produce said signal in said signal conductor.

2. The push button panel according to claim 1, wherein the signal transfer is so arranged that the signal is transferred, at least through part of the transfer distance, between the plates away from the push button area.

3. The push button panel according to claim 1, wherein the push button panel is attached to an elevator car wall or a landing wall by fixing elements.

4. The push button panel according to claim 1, wherein the front plate forms part of a plate structure of an elevator car wall or a landing wall and wherein the pressure sensitive film is attached to the backside of the plate structure of the car or landing wall.

5. The push button panel according to claim 4, wherein a front surface of the elevator car wall or the landing wall is provided with symbols indicating push button areas.

6. The push button panel according to claim 1, further including signaling elements placed near the push button areas and designed to indicate a call received and/or to be served.

7. The push button panel according to claim 1, wherein said pressure sensitive film is provided with an electrode electrically connected to said signal conductor and in which, at least in the area of the electrode, mechanical work applied to the film produces an electric change in the electrode.

8. The push button panel according to claim 1, wherein said indicator means is located at a rear side of said back plate.

9. The push button panel according to claim 1, wherein said indicator means comprises at least one light emitting diode.

10. The push button panel according to claim 1, wherein said front plate includes a window through which said indicator means is visible.

11. A push button panel comprising:

a substantially rigid front plate having a front surface and a rear surface, said front surface including at least one push button area located thereon;

a back plate located proximate to said rear surface of said front plate;

a pressure sensitive film located between said front plate and said back plate and abutting said front plate and said back plate;

at least one signal conductor associated with said pressure sensitive film for conducting a signal produced by said pressure sensitive film; and indicator means for indicating when mechanical work has been applied to the push button area;

whereby mechanical work applied to the push button area is transferred to the pressure sensitive film to produce said signal in said signal conductor, and wherein said pressure sensitive film includes a pair of electrodes, and wherein said signal corresponds to a change in capacitance between said pair of electrodes.

12. The push button panel according to claim 1, wherein said pressure sensitive film includes means for converting mechanical energy into electrical energy.

13. The push button panel according to claim 1, wherein said indicator means is located at a rear side of said back plate, and wherein said front plate includes a window through which said indicator means is visible.

* * * * *